United States Patent [19]

Wada et al.

[11] 4,096,000

[45] Jun. 20, 1978

[54] ANNEALING SEPARATOR FOR SILICON STEEL SHEETS

[75] Inventors: Toshiya Wada; Toshihiko Takata, both of Kitakyushu, Japan

[73] Assignee: Nippon Steel Corporation, Tokyo, Japan

[21] Appl. No.: 459,232

[22] Filed: Apr. 8, 1974

[30] Foreign Application Priority Data

Apr. 11, 1973 Japan ..... 48-41134

[51] Int. Cl.[2] ..... B23K 35/24

[52] U.S. Cl. ..... 148/27; 148/31.5; 148/113

[58] Field of Search ..... 148/27, 31.5, 113, 122, 148/31.55, 111

[56] References Cited

U.S. PATENT DOCUMENTS

| | | | |
|---|---|---|---|
| 2,889,238 | 6/1959 | Long et al. | 148/27 |
| 3,583,887 | 6/1971 | Steger et al. | 148/27 |
| 3,676,227 | 7/1972 | Matsumoto et al. | 148/111 |
| 3,697,322 | 10/1972 | Lee et al. | 148/113 |
| 3,827,922 | 8/1974 | Boggs et al. | 148/113 |

*Primary Examiner*—Walter R. Satterfield

*Attorney, Agent, or Firm*—Toren, McGeady and Stanger

[57] ABSTRACT

An annealing separator for silicon steel sheets comprising not less than 90.00% by weight of an MgO and 0.01 to 2.0% by weight of $B_2O_3$ in the form of $nMgO.B_2O_3$ with the balance being unavoidable impurities.

2 Claims, No Drawings

ANNEALING SEPARATOR FOR SILICON STEEL SHEETS

The present invention relates to a composition of annealing separator for silicon steel sheets which can provide a film of extremely high uniformity.

Various refractory materials have been conventionally used for the annealing separators for the silicon steel sheets, and magnesium oxide (MgO) has been most commonly used for the purpose.

The main object of the annealing separator is to prevent sticking of the steel sheets or strips which occurs during the annealing of silicon steel sheets or strips in a piled state or in a coil form at a temperature as high as 1200° C.

For assuring satisfactory prevention of the sticking of the sheets or strips during the annealing, it is necessary that the purity of the separator is high and impurities, such as, alkali are not contained in the separator.

However, in addition to the above purpose, the separator is used to react with impurities such as, sulfur, etc., in the steel thereby transferring the impurities into the separator for their removal from the steel. For this purpose, the separator contains oxides of alkali metals, such as, MgO and CaO.

Recently, the main purpose of the separator has been shifted to include the formation of a glass-like film by the reaction with $SiO_2$, $Fe_2SiO_4$, and FeO etc. which are present on the surface of the silicon steel sheet. This glass-like film has been known to be effective as an electric insulating film of the silicon steel and to provide tension for improving the magnetic properties and magneto-striction, and a uniform glass-like film having good adhesion is considered to be indispensable for grain-oriented silicon steel sheets.

Up to now, many inventions and proposals have been made and published concerning annealing separators which provide excellent glass-like films.

The glass-like films have a very important influence on the quality of the steel products and the estimation of the amount or effectiveness of the glass film is made from its adhesion, namely, from degree of peeling-off when the silicon steel sheet is sheared or bent into iron cores and the like, the occurrence of partial defects, surface appearance, etc.

Various known methods have been tried for obtaining good glass-like films.

For example, it is already known that oxides such as $SiO_2$ are added to annealing separators composed mainly of MgO for obtaining satisfactory formation of the glass-like film, or the surface of the steel sheet is oxidized and $TiO_2$, $MnO_2$, $CrO_3$, $Cr_2O_3$, etc. are added to the annealing separator in order to form an appropriate amount of $SiO_2$ to FeO on the steel surface.

Further, U.S. Pat. No. 3,583,887 and U.S. Pat. No. 3.676,227 disclose that an annealing separator composed of MgO with the addition of boric acid or boron compounds is effective for forming a uniform film.

According to U.S. Pat. No. 3,583,887, the adhesion of the glass-like film is improved by the addition of boric acid or a boron compound together with $SiO_2$ and NaO, etc., to the separator and the so-called anneal patterns due to difference of the color of the glass-like film are eliminated and a uniform film is obtained.

The present inventors have made various experiments based on the teachings of the above patents and so on, and it has been confirmed that the improvement of the glass-like film as above mentioned can be obtained by adding boric acid, etc., to the annealing separator. But the results were not satisfactory and various defects as mentioned here under have been revealed.

(1) Occurrence of Spangles

A spangle is the existence of very thin glass-like film in which the grains of the base metal are visible through the film, and the spangle occurs on portions where the annealing separator peels off prior to the annealing or during the annealing and on portions where the components of the film are reduced by the atmospheric gases.

Further the spangles often occur on the whole surface of one side of the steel sheet.

There are various causes for the spangles, but it is always a result of the thickness of the glass-like film being extremely thin on that portion. If the glass-like film is accompanied by such defects, it is not possible to obtain satisfactory iron cores due to the lack of interlaminar resistance in the case when the steel sheet is worked into coiled cores or laminated cores for transformers.

(2) Occurrence of Bare Spots

The bare spot is a defect which occurs in the form of spots on the portions where no glass-like film is present.

The cause of the bare spot defect is attributed to the fact that the annealing separator is stripped off by local rubbing during the coiling of the sheet having the annealing separator thereon, or after the sheet is coiled, and the portion where the separator is stripped off is oxidized and reduced in the last half section of the annealing so that the base metal without any glass-like film is exposed.

In addition to the above, the excessive annealing separator is washed and removed after the annealing, and in this case, the excessive annealing separator, particularly MgO, takes a sintered form and often can not be removed from the glass-like film. This causes lowering of the space factor and poor surface appearance, and further, when an insulation film is to be formed thereon, only a powderly coating is obtained which causes significant defect.

Generally, when a good glass-like film is to be formed on the surface of the silicon steel sheet, burning of the MgO content of the annealing separator tends to increase. This is considered to be due to the fact that oxides of the steel components diffuse into the MgO.

As mentioned above, the annealing patterns can be reduced but can not be eliminated only by the addition of boric acid or boron compounds in the annealing separator.

When the steel coil is loosely coiled during the annealing or when the atmosphere is strongly oxidizing, the portions which have been strongly influenced by the annealing atmosphere from one end portion of the strip width and the other portions will have different qualities and colors of the glass-like film so that annealing patterns will appear.

Such non-uniformity of the glass-like film is caused by various factors, such as, the nature of the annealing separator, the thickness and nature of the oxide layer of the steel surface which is the base of the glass-like film, and the annealing atmosphere, and it has been considered very difficult to solve the problem.

One object of the present invention is to provide an annealing separator for annealing of electrical steel sheets, which separator is free from the above defects.

The annealing separator according to the present invention contains not less than 90.00% (by weight) of MgO and 0.01 to 2.0% of $B_2O_3$ in the form of $nMgO.B_2O_3$, with the balance being unavoidable impurities.

It is one of the features of the present invention that the boron oxide added in the annealing separator is contained in the form of $nMgO.B_2O_3$, particularly $3MgO.B_2O_3$.

According to U.S. Pat. No. 3,583,887, the boron in the annealing separator containing boric acid, etc. is contained in the form of $B_2O_3$ or $H_3BO_3$ and is not contained in the form of a complex compound as $nMgO.B_2O_3$ as in the present invention.

The glass-like film formed on the surface of the silicon steel is generally an enamel film of $SiO_2$-MgO-FeO. When $B_2O_3$ is added thereto the film is of $SiO_2$-MgO-FeO-$B_2O_3$ and thus $B_2O_3$ has the function of promoting the film formation of such a composition.

However, in contrast to an enamel film on an ordinary steel sheet, the glass-like film formed on the surface of the silicon steel sheet is susceptible to a large variation in the composition ratio, because part of the MgO is converted to $Mg(OH)_2$ when the glass-like film is formed at high temperatures using an annealing separator composed mainly of MgO, and the moisture content is liberated at a temperature above 400° C to cause oxidation of the surface of the steel sheet so that the formation ratios of FeO and $SiO_2$ vary due to the ratio of $H_2O/H$. However, when $B_2O_3$ or $H_3BO_3$, etc., is added to the MgO, the reaction of $MgO \rightarrow Mg(OH)_2$ proceeds rapidly and more hydration is obtained than in the case where water is simply added to MgO.

Therefore, even if some improvement of the glass-like film can be obtained by the function of $B_2O_3$, etc., the chance of oxidation by the annealing atmosphere increases so that the tendency of deterioration of the film increases.

According to the discoveries of the present inventors, the ability of forming excellent glass-like films is obtained only when $B_2O_3$ is present in the form of $nMgO.B_2O_3$ resulting from the reaction with MgO.

Therefore, it is necessary that the boron content present in the annealing separator is already present in the form of $nMgO.B_2O_3$ before the annealing separator is applied on the silicon steel sheet.

According to the present invention, it is necessary that the annealing separator contains not less than 90% of MgO, and if the MgO content is less than 90%, satisfactory performance of the annealing separator can not be obtained and formation of an excellent glass-like films can not be attained.

It is also necessary that the boron compounds are contained in the form of $nMgO.B_2O_3$ in an amount between 0.01 and 2.0% calculated as $B_2O_3$. If $B_2O_3$ in the form of $nMgO.B_2O_3$ is present in an amount less than 0.01%, no improvement of the glass-like film can be obtained and on the other hand, if it is present in an amount more than 2.0%, the formed film is easily reduced and thus the object of the present invention can not be attained.

Further, in the present invention, the boron compound should be contained in the form of $nMgO.B_2O_3$ as mentioned above, and it is desirable that the boron compound is present in the form of $3MgO.B_2O_3$.

The annealing separator of the specific composition defined in the present invention may be obtained by mixing boric acid or a boron compound with ordinary materials for MgO production such as magnesium hydroxide, basic magnesium carbonate and magnesium carbonate, etc., stirring the mixture well and baking the mixture at a temperature above 850° C.

It is more desirable that the boric acid or the boron compound is added in the form of aqueous solution, but it may be added in the form of a suspension and the boron compounds are added so as to obtain a $B_2O_3$ content between 0.01 and 2.0%.

The mixture thus obtained is then separated from the of water by a suitable means, such as, filtering, and further, the mixture is dried at a temperature between 100 and 200° C for example, and then calcined at a temperature above 850° C, and further, if necessary, ground and classified into a particle size under about 320 mesh.

The annealing separator of the present invention is prepared as above, but the present invention is not limited to the above production method.

Table 1 shows the compositions and the products obtained by calcination at 900° C with various ratios of MgO and $B_2O_3$. Among the products, the preferred composition for forming the film is obtained by $3MgO.B_2O_3$. With a smaller $B_2O_3$ content, this ability decreases.

Table 1

| Composition (wt.%) | | Products |
|---|---|---|
| MgO | $B_2O_3$ | |
| 90 | 10 | $MgO + 3MgO . B_2O_3$ |
| 60 | 40 | $3MgO . B_2O_3 + 2MgO . B_2O_3$ |
| 50 | 50 | $2MgO . B_2O_3 + MgO . 2B_2O_3$ |
| 20 | 80 | $MgO . 2B_2O_3$ |

The present invention will be more clearly understood from the following examples.

EXAMPLE 1

100 g of an annealing separator containing 0.01% of $3MgO.B_2O_3$ calculated as $B_2O_3$ with the balance being MgO and unavoidable impurities was mixed in 600 cc of pure water and applied in an amount of 13g/m² on the surface of a 3% silicon steel sheet which has been subjected to decarburization annealing and sulfuric acid pickling.

The surface appearance and resistance of the glass-like film formed by annealing the steel sheet at 1200° C for 20 hours in hydrogen are shown in Table 2 in comparison with those of the film obtained from a composition containing no $B_2O_3$.

Table 2

| Separator | Appearance | Franklin Test | Remarks |
|---|---|---|---|
| Comparative | Occurrence of Spangle Patterns | 990 mA | Franklin Test was done according to JIS "Method For Measuring Interlaminar Resistance of Electrical Steel Sheets(Table 2)" |
| Inventive | Uniform Glass Formation | 150 mA | |

As understood from the above results, the annealing separator according to the present invention gives very excellent film and interlaminar resistance.

EXAMPLE 2

100 g of an annealing separator containing 0.8% of $3MgO.B_2O_3$ calculated as $B_2O_3$ with the balance being MgO and unavoidable impurities was dissolved in 600 cc of pure water and applied in an amount of 10 g/m² on the surface of a 3% silicon steel sheet which has been subjected to decarburization annealing, and the thus applied steel sheet was annealed at 1200° C for 20 hours in hydrogen. The results are shown in Table 3 in comparison with those obtained by a comparative separator containing no $B_2O_3$.

Table 3

| | Film Condition |
|---|---|
| Inventive | Uniform glass-like film on the whole surface without defects |
| Comparative | Glass-like film on the back surface was thin and spangle-like |

What is claimed is:

1. An annealing separator for silicon steel sheets consisting essentially of not less than 90.00% by weight of MgO and 0.01 to 2.0% by weight of $B_2O_3$ in the form of $nMgO.B_2O_3$ with the balance being unavoidable impurities.

2. An annealing separator according to claim 1, in which the $B_2O_3$ is present in the form of $3MgO.B_2O_3$.

* * * * *